United States Patent [19]

Percoco

[11] 4,195,870

[45] Apr. 1, 1980

[54] SECURITY STRIKER PLATE

[75] Inventor: Jane Percoco, Hull, Mass.

[73] Assignee: Jane Percoco, Hull, Mass.

[21] Appl. No.: 935,743

[22] Filed: Aug. 21, 1978

[51] Int. Cl.[2] ..... E05C 13/00

[52] U.S. Cl. ..... 292/340

[58] Field of Search ..... 292/340, 346, 341.18, 292/341.19, 341

[56] References Cited

U.S. PATENT DOCUMENTS

| | | | |
|---|---|---|---|
| 1,377,458 | 5/1921 | Block | 292/346 X |
| 2,127,891 | 8/1938 | Starling | 292/346 |
| 2,255,860 | 9/1941 | Riedel | 292/346 X |
| 3,888,530 | 6/1975 | Fabrici | 292/346 X |

*Primary Examiner*—Richard E. Moore

[57] ABSTRACT

Several different designs of striker plate assemblies, for providing a stronger construction so as to resist a forced entry by applying pressure against a door; a first design including the striker plate secured to a metal angle fastened to a door frame beam in two different planes; a second design using a metal block instead of the metal angle of the first design; a third design having the striker plate itself made in an angle shape, so as to be fastened by screws in two different planes; a fourth design being a modification of the second design, in which the metal block includes a flange extending behind a door frame; and a fifth design of the invention including a metal block, which additionally is secured to the door frame in a third plane, so as to form a three-dimensional securement against a shearing force from any direction.

1 Claim, 10 Drawing Figures

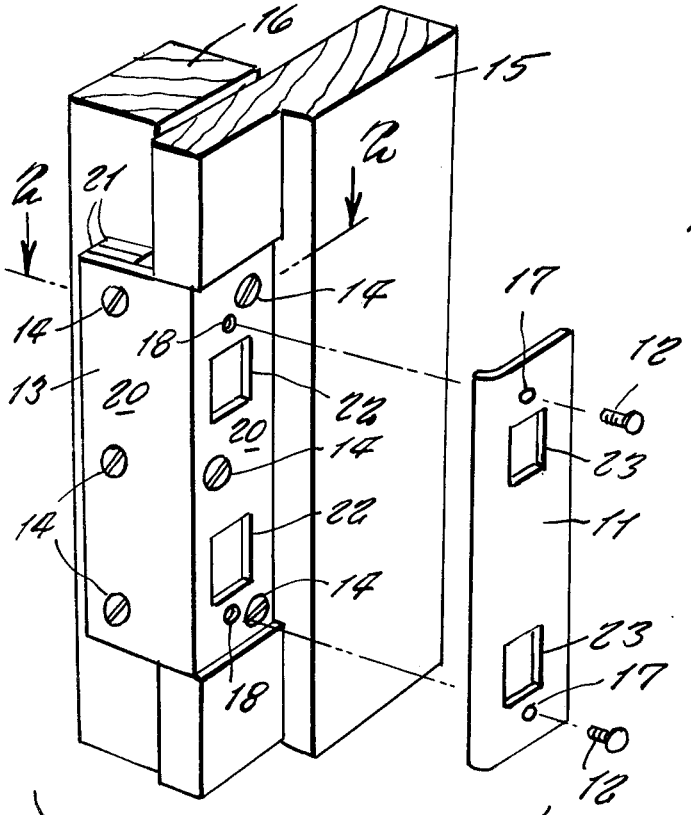
Fig. 1
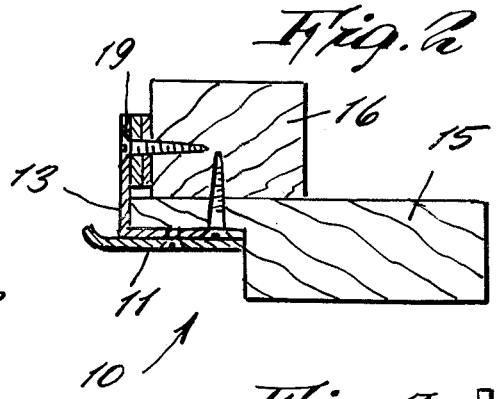
Fig. 2
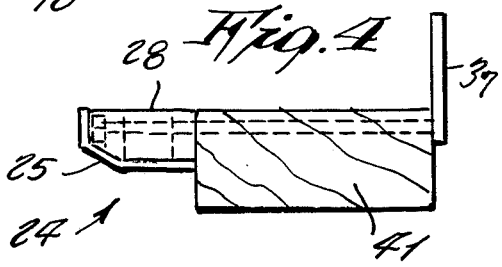
Fig. 4
Fig. 3
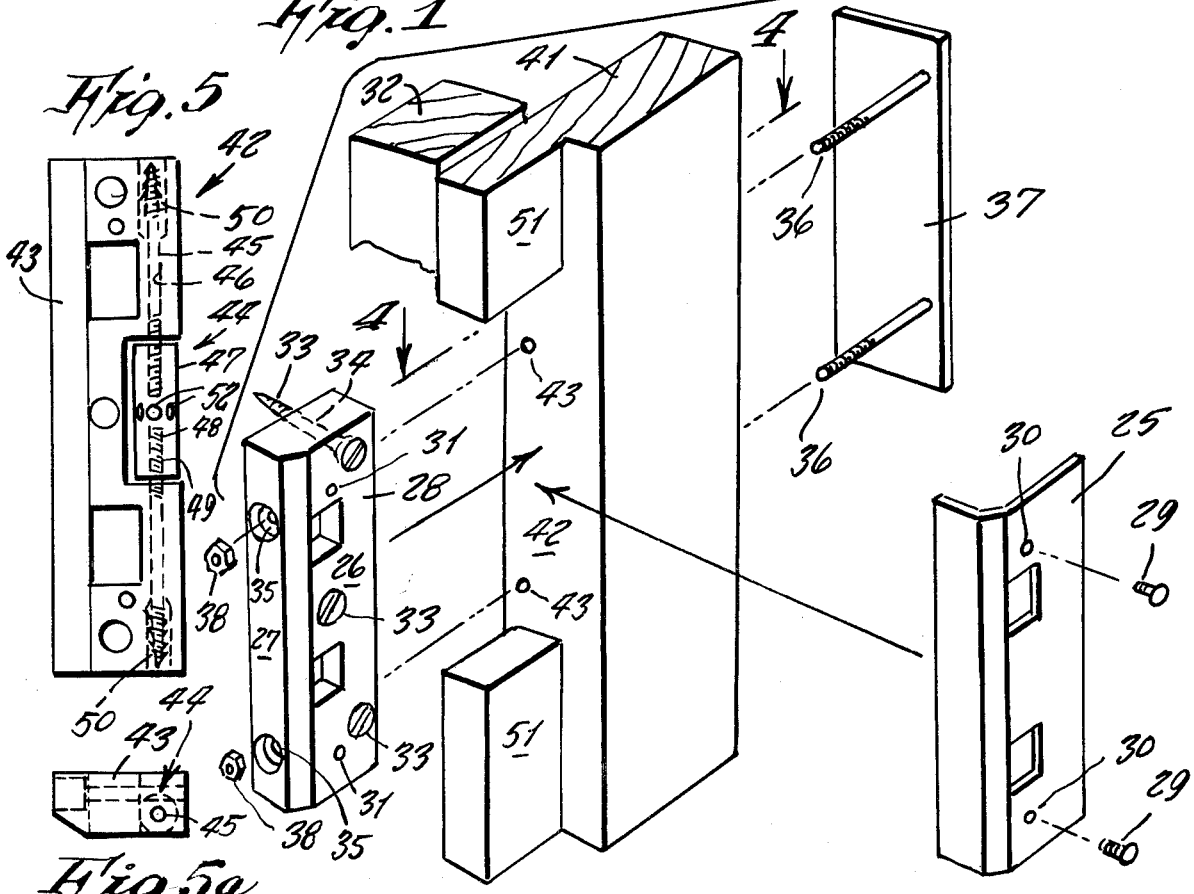
Fig. 5
Fig. 5a

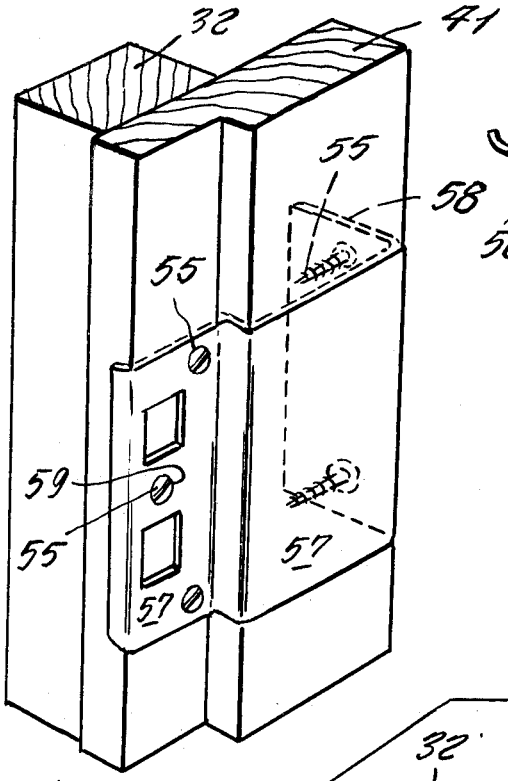
Fig. 6
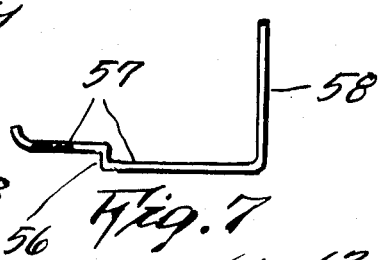
Fig. 7
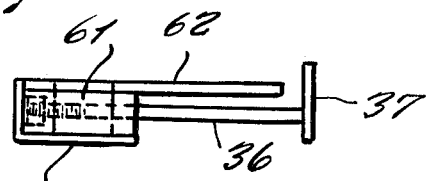
Fig. 9
Fig. 8
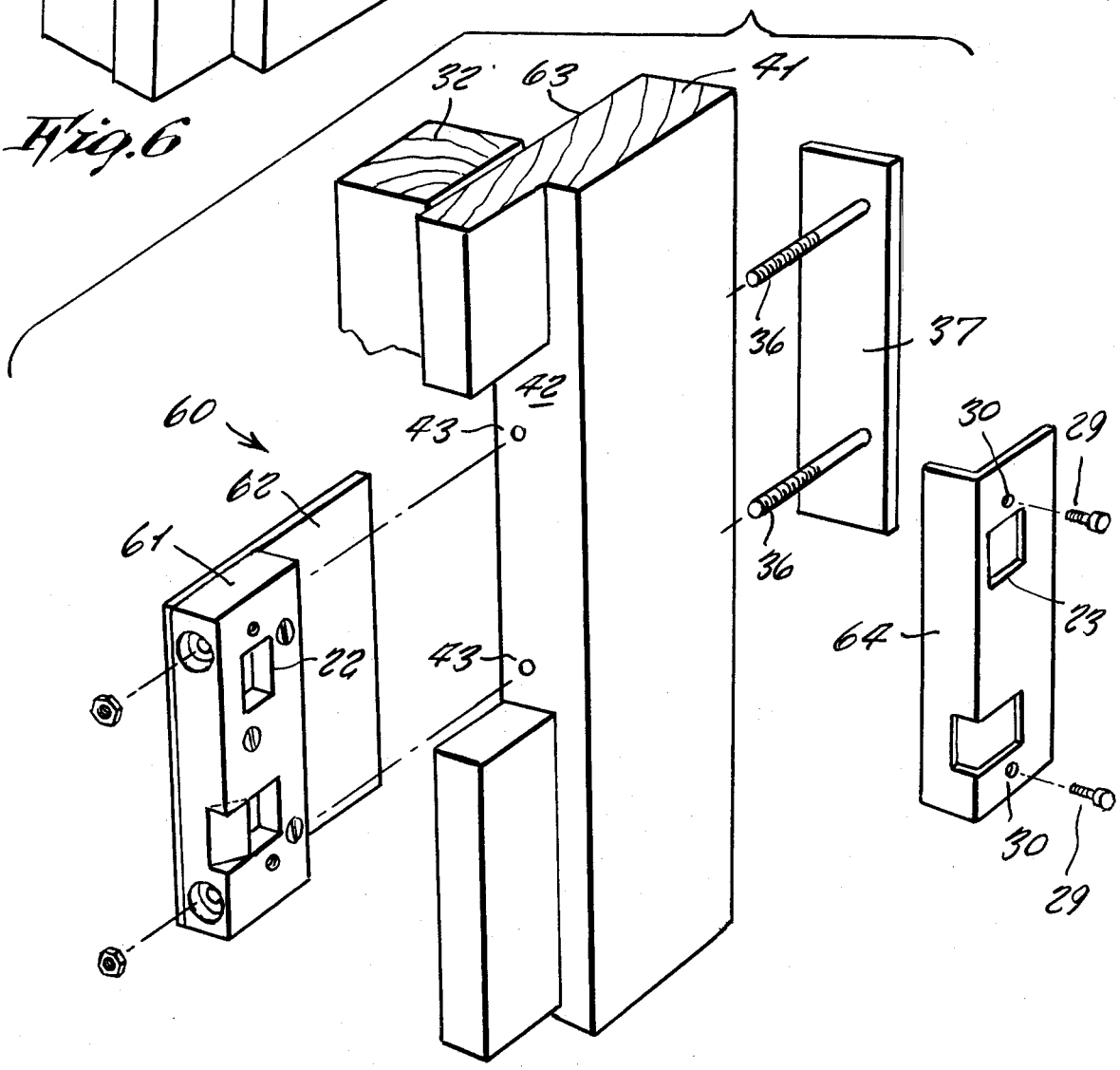

SECURITY STRIKER PLATE

This invention relates generally to entrance door striker plates, and the mountings therefor.

It is well known, that in these times of increased crime and breakage into homes for burglarizing purposes, a conventional door striker plate does not sufficiently resist a forced entry, if sufficient pressure is applied, so as to cause the striker plate mounting screws to fracture or crack the door frame wood in which they are screwed. These screws are all located on a single plane resisting a shearing force which, if adequate, splinters the wood, so as to allow the door to swing open. This situation is objectionable, and is therefore in want of an improvement.

Accordingly, it it a principal object of the present invention to provide a security striker plate, that is held in two or even three different planes, so as to more strongly resist against being torn away from its mounting.

Another object, accordingly, is to provide a security striker plate, which is held in different directions, and which can be readily and quickly installed in a door frame.

Other objects are to provide a security striker plate, which is simple in design, inexpensive to manufacture, rugged in construction, easy to use and efficient in operation.

These, and other objects, will be readily evident, upon a study of the following specification, and the accompanying drawing, wherein:

FIG. 1 is a perspective view of one form of the present invention;

FIG. 2 is a cross-sectional view taken along the line 2—2 of FIG. 1;

FIG. 3 is a perspective view of a modified form of the invention;

FIG. 4 is a view taken along the line 4—4 of FIG. 3;

FIG. 5 is a side elevational view of still another form of re-inforcing block, which is the same as the block shown in FIG. 3, except that it additionally includes turnbuckle-operated upper and lower screws, so that it is secured in three dimensional directions for additional security strength;

FIG. 5*a* is an end elevational view of the block shown in FIG. 5;

FIG. 6 is a perspective view of yet another modified design, wherein the striker plate is angled so as to extend around a door frame;

FIG. 7 is a top view of the striker plate of FIG. 6;

FIG. 8 is a perspective view of yet another design, which extends around three sides of a door frame, and FIG. 9 is a top view thereof, shown assembled.

Referring now to the drawings in greater detail, and more particularly, to FIGS. 1 and 2 thereof at this time, the reference numeral 10 represents a security striker plate assembly, according to the present invention, wherein there is a metal striker plate 11 secured by screws 12 to a metal, re-inforcing angle 13, which is secured by wood screws 14 in two different directions or planes, at right angles to each other, to a wooden door frame 15, and wooden beam 16, alongside a doorway of a house or building, in order to be a stronger construction than a conventional striker plate secured in a single direction or plate, directly to a wooden doorway. The screws 12 are, accordingly, machine screws passed through clearance holes 17 of the striker plate, and into threaded holes 18 of the angle. The angle has countersunk holes 19, on each of its two sides 20, for receiving the screws 14. If necessary, shims 21 may be placed between the angle and the beams, so that the angle is rigidly mounted. It is to be noted, that the angle also includes lock slide bolt openings 22, that align with the conventional openings 23 of the striker plate, so that the bolts also enter the same, when the door is locked.

In operative use, it is now evident that fastening to a doorway structure is in two planes, so as to resist splintering a wooden doorway. Also, in a metal door, some of the screws 14 resisting a shear force, while others resisting a pulling force, would likewise strengthen the same.

In FIGS. 3 and 4, a modified design of security striker plate assembly 24 includes a striker plate 25, of angle-shape, so as to wrap around two sides 26 and 27 of a metal re-inforcing block 28, and is secured thereto by machine screws 29, passed through clearance holes 30, and engaged in threaded holes 31.

The block 28 is secured to a two by four wooden beam 32 of the doorway, by means of wood screws 33, which extend through holes 34 at right angles to holes 35 in the block, and which receive studs 36, welded to stud plate 37. The studs are threaded, so as to receive nuts 38, seated in counterbored ends of holes 34, and which are covered over by a side 39 of the striker plate. The stud plate is located on an opposite side 40 of a wooden door frame 41, respective to a side 42, against which the block abuts. Openings 43, through the frame 41, allow the studs to pass therethrough.

In summary, the block is secured in two planes by screws 33 and the studs; and the frame 41 is clamped between the block and stud plate, so that, even if it were possible to splinter the frame, the block could not be torn away therefrom.

In FIGS. 5 and 6, yet another design of assembly 42 is the same as assembly 24, except that the block 28 thereof is substituted by a block 43, that additionally includes a turnbuckle 44, whereby cross-sectionally square pins 45 slide axially in square holes 46 of the block, when a barrel 47 is rotated; the barrel having opposite direction threaded openings 48, in each end, engaging a threaded end 49 of each pin. In this design, spurred, pointed ends 50 of the pins drive into upper and lower portions 51 of the frame 41; the pins being along an axial plane that is different from the planes of the screws 33 and studs, so as to result in a three-dimensional securement. Radial holes 52, through the barrel, allow insertion of a nail or rod, so as to rotate it short distances at a time, in the confined space.

In FIGS. 6 and 7, still another design 53 of the assembly comprises merely a striker plate 54 and mounting screws 55, extending through the plate in two planes at right angles to each other. The striker plate is generally angle-shaped with an additional right angle offset 56, on one of its sides 57, which is at right angles to a side 58. Each side, 57 and 58, has countersunk holes 59, for receiving the screws. The screws are screwed into the beam 32 and frame 41.

In FIGS. 8 and 9, still another design 60 is generally the same as design 24, except, in this design, the block 61 is integral with a steel plate 62 on one of its sides; the plate 62 extending around a third side 63 of the frame 41, so as to additionally prevent tearing away a block from the wooden frame. The striker plate 64 is angle-shaped.

While various changes may be made in the detail construction, it is understood that such changes will be within the spirit and scope of the present invention, as is defined by the appended claims.

What I now claim is:

1. A security striker plate assembly, comprising, in combination, a striker plate and a support means whereby said striker plate is supported from a doorway frame and stand in a plurality of directional planes at right angles to each other; said means comprising a metal block having a plurality of holes therethrough in two different directional planes, and mounting directional screws and studs of a stud plate received in said holes; said block including a turnbuckle secured in a third directional plane, said turnbuckle comprising a manually rotatable barrel having a right- and left-hand threaded opening at opposite ends, a threaded pin in each of said end openings of said barrel, a cross-sectional substantially square portion of each said pins being slideable in a correspondingly square hole at opposite ends of said block, and an end of each said pins being spur pointed whereby each of said pins is slideable outwardly of each said block hole end and into adjacent upper and lower portions of said doorway frame.

* * * * *